United States Patent [19]

Sroka

[11] Patent Number: 4,573,377

[45] Date of Patent: Mar. 4, 1986

[54] LIGHTWEIGHT POWER WRENCH

[76] Inventor: John S. Sroka, 1305 Washington Ave., Parma, Ohio 44113

[21] Appl. No.: 712,749

[22] Filed: Mar. 18, 1985

[51] Int. Cl.[4] ..... B25B 17/00

[52] U.S. Cl. ..... 81/57.2; 81/57.3

[58] Field of Search ..... 81/57.14, 57.2, 57.3

[56] References Cited

U.S. PATENT DOCUMENTS

| | | | |
|---|---|---|---|
| 527,103 | 10/1894 | Barrett | 81/57.2 |
| 4,098,151 | 7/1978 | Bliss | 81/57.3 |
| 4,306,471 | 12/1981 | Bottoms | 81/57.2 |
| 4,374,479 | 2/1983 | Minotti | 81/57.3 |

*Primary Examiner*—James L. Jones, Jr.
*Attorney, Agent, or Firm*—George A. Kap

[57] ABSTRACT

A relatively lightweight wrench is disclosed herein which is characterized by a gear mounted at its periphery for rotation within a housing, said gear having a major and a minor gear sections removably secured to each other, a collet disposed within the gear for rotation therewith, said collet having an opening of a geometric shape to accommodate a work piece and an open side for admitting a work piece thereinto and a block cooperating with the minor gear section for closing-off the open side of the collet. The wrench is adapted to be opened by removing or opening the minor gear section and removing the collet block to expose a passage leading into the collet opening. In assembling the wrench, a work piece corresponding in shape to the collet opening is passed through the passage into the collet opening, the collet block is positioned in place to close-off the collet opening, and the minor gear section is again secured to the major gear section. In this operating position, the gear is turned by means of a drive means disposed within the housing for transferring torque to the gear for turning the gear, the collet and the work piece in unison.

13 Claims, 9 Drawing Figures

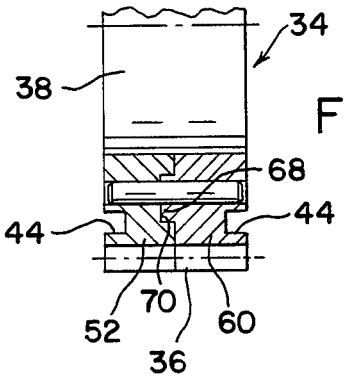
FIG. 5
FIG. 6
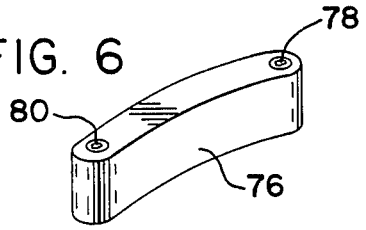
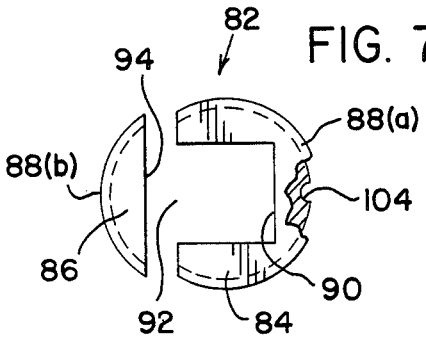
FIG. 7
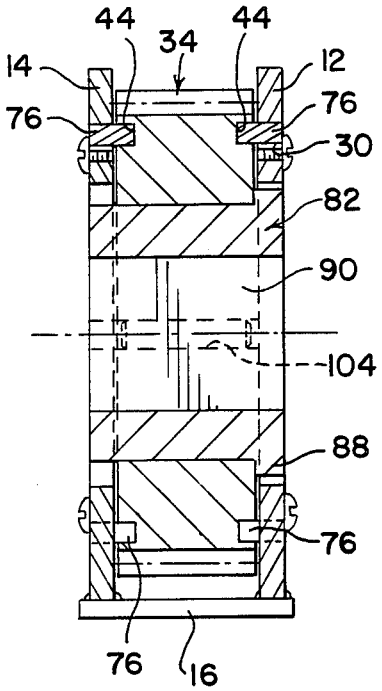
FIG. 8

LIGHTWEIGHT POWER WRENCH

BACKGROUND OF THE INVENTION

This invention is generally directed to a universal wrench which can be energized by means of a drill or an impact wrench, or by any other suitable drive means, to fasten, to loosen, or adjust a work piece or a fastener system. The wrench disclosed herein is characterized by a removable gear portion which permits insertion of a work piece between its ends in order to apply a torque thereto without having the option of slipping the wrench over one or the other end of the work piece.

There are many work pieces, including fastener and alignment mechanisms, that are secured at their opposite ends to fixed supports. Such work pieces can be adjusted in terms of their overall length by an adjusting means positioned generally intermediate its ends. Since a typical power wrench cannot be slipped over an end of such a work piece, other means must be used to make the necessary adjustment.

Situations abound where the work pieces, and particularly alignment mechanisms, are found. For instance, adjustable torque arms are used to align a set of wheels on a truck or a trailer relative to each other. In such situation threaded bolts are used on the order of 1 to 2 feet (0.3–0.6 meter) in length and about ½"(1.3 cm) in thickness. Also, long tension bars or cables are used in the construction industry to secure or position structural members. Also, a commonly encountered situation arises when an adjustable fastener system is disposed between fixed spaced walls. In such mechanisms, a turnbuckle is generally positioned intermediate the ends of such mechanisms to provide for adjusting the length of the cables or bars. In other arrangements, a nut can be used to secure threaded ends of a pair of rods, adjustment of which can be made by turning the nut or individual rods.

There is also another application that warrents attention. Sockets, or similar means, can be inserted into the collet herein and the wrench can be used to loosen or fasten bolts and the like.

In the past, adjustment of such mechanisms was accomplished by means of large mechanical wrenches or bars or rods that were inserted in a fastener component and then turned. Needless to say, the use of conventional means to fasten, loosen or adjust such mechanisms was not effective since conventional tools often slipped causing unnecessary injury. Furthermore, such conventional tools rely on manual strength of an individual to provide the necessary torque to turn a nut or a turnbuckle and at times, adequate manual strength is lacking.

BRIEF DESCRIPTION OF THE DRAWINGS

The invention herein is illustrated by the following figures which depict a preferred embodiment of the wrench:

FIG. 5 is an enlarged view of engaging sections of the gear parts revealing the tongue and groove arrangement;

FIG. 6 is a perspective view of one of the key elements that position the gear with respect to the housing when disposed in keyways;

FIG. 7 is a front view of a collet that is positioned within the gear and which can be replaced with another one to accommodate a work piece of a different size or shape;

FIG. 8 is a general cross-sectional view of the collet disposed within the gear and the gear disposed within the housing, this figure particularly illustrating the collet circumferential lip disposed over the inner gear surface.

SUMMARY OF THE INVENTION

Figure 2:
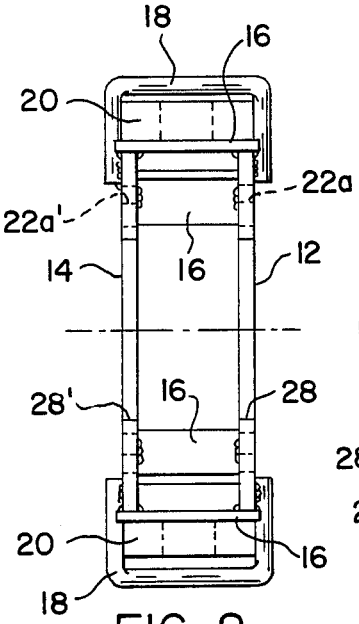
FIG. 2 is a side view of the wrench housing.

This invention relates to a power wrench having a gear with an interior opening corresponding in shape to a removable open ended collet disposed within the gear and rotatable therewith. The gear is characterized by a removable gear section that is securely fitted onto the gear to close-off the open end of the collet. The gear is disposed within a housing and is rotatable within the stationary housing around its axis. The gear has a circumferential groove on both of its faces whereas the housing has segmental circumferential openings or keyways in its opposite walls which are in alignment with the grooves in the gear. Circumferential key elements are disposed in the keyways in the housing and also project into the grooves in the gear. It is the key elements that solely support the gear within the housing for rotation around its axis. A drive means is also provided in conjunction with the gear to impart torque thereto of sufficient magnitude to rotate the gear.

DETAILED DESCRIPTION OF THE INVENTION

The principal feature of this invention resides in the provision of a removable gear section in a power wrench to enable the use of such a wrench in situations where the wrench cannot be slipped over one or the other end of a work piece. In such a situation, both ends of the work piece are secured to a fixed object and cannot easily or practically be disengaged so that a wrench can be slipped over one end thereof.

The term "work piece" as used herein, generally refers to any fastener arrangement that can be used to fasten or secure structural members in an automotive, construction or any other application where such a fastener might be used. The components of such a work piece generally include a pair of cables, a pair of rods or bars, or a pair of one and the other, with a fastening means securing one end of a cable or a rod to another end of a cable or a rod. Most prevalent fastening means is the internally threaded nuts and turnbuckles having a pair of spaced nut elements.

The power wrench of this invention is unique in s number of respects. The driven gear which translates torque from a drive means to a work piece, has a removable portion which when removed, provides an open-end wrench. The removable portion is retracted in order to position the wrench over a work piece through the open end of the wrench. After the wrench is positioned over a work piece through the open end, the removable gear portion is returned to its original closed position and secured in such a position with removable pins. In this way, the open end of the wrench is closed off and the work piece is securely disposed within the wrench, having abutting structure on its exterior surfaces parallel to the longitudinal axis of the gear. Since the wrench does not have any open portions, it can be used to apply large torque to the fastener system without fear of having it slip and cause injury.

The power wrench of this invention is distinctive in another way. The driven gear has a circumferential groove on each of its faces which is in alignment with segmental openings in the housing. Key elements, in the shape of circumferential strips are positioned within the openings in the housing and protrude into the circumferential grooves in the gear. The key elements which are disposed along the major portion of the gear circumference are the sole means of positioning the gear within the housing. This means that positioning of the gear within the housing is accomplished without any dependence of a central shaft mounting or any other similar means.

The wrench described herein is generally lightweight and can be easily carried in on hand, although it is possible to construct very large and very heavy wrenches of the type described herein. Generally speaking, wrenches of this inbention can weigh from about 5 pounds to about 50 pounds.

In the description of the several figures that follows, primed numbers are used to identify corresponding parts on plate 14, that are not shown.

Figure 1:
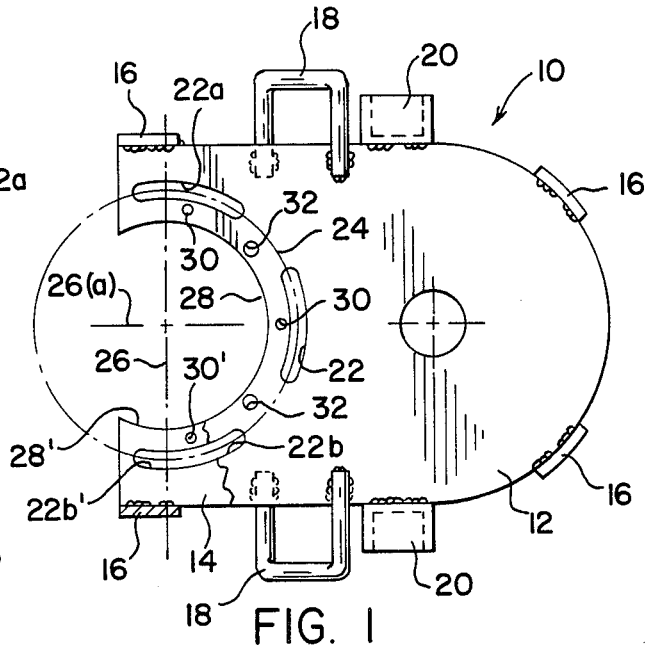
FIG. 1 is front view of the wrench housing by itself that consists of a pair of spaced plates.

Referring to FIG. 1 housing 10 is composed of two plates 12, 14 that are disposed in an opposing evenly spaced relationship to each other. Plate 12 being the front plate and plate 14 being the rear plate. The plates are secured in a spaced relationship by means of spacers 16 that are arranged around the periphery of the housing plates and are secured thereto, as by welding. The spacing between the plates is on the order of about 1"(2.54 cm) which corresponds to the thickness of the gear. Handles 18 can be provided on the plates at suitable locations to facilitate handling of the wrench. Additionally, cups 20 can also be secured at convenient places for insertion of rods or bars for the purpose of facilitating holding and stabilizing the wrench when in use.

The plates also contain other structural elements that contribute to proper arrangement of the wrench components. Three keyways 22 are shown arranged along a circumferential path defined by imaginary circle 24. Keyways 22 extend through plate 12 and corresponding keyways 22', not shown, are provided in plate 14. Keyways 22' are identical to keyways 22 in every respect and are located in plate 14 in such a way that they are partially aligned along the horizontal plane with keyways 22. Although three keyways in plate 12 are shown, any number can be provided. There is one condition that should be satisfied if the wrench is to operate in the intended manner: the outside keyways **22*a* and 22*b* should extend beyond the vertical centerline 26 of imaginary circle 24 or greater than 180°. This condition is necessary if the gear is to be maintained in a rotary condition solely by the key elements that are disposed within keyways 22 and extend into the gear, as is later more fully described. The vertical centerline 26 is shown as cutting through the terminal portions of keyways 22*a* and 22*b*. This is the arrangement that is necessary if the key elements are to be the sole means of securely positioning for rotation the gear relative to the housing. If the keyways 22*a* and 22*b* do not extend at least to the vertical centerline 26 or 180°, additional means must be provided to secure the gear within housing 10**.

As is clearly shown in FIG. 1, front plate 12 has a circular cutout 28 in the forward edge thereof. Similar corresponding cutout 28' is also provided in rear plate 14. Circumferential extent of cutouts 28,28' is also greater than 180° and extends beyond the vertical centerline 26. The purpose of the cutouts is to permit insertion and retraction of gear and collet, as is explained hereinafter.

A number of openings are also provided in the housing for the purpose of attaching or positioning structural elements of the wrench. Openings 30 are associated with keyways 22 and extend into but not necessarily through plate 12. Corresponding openings 30' are provided similarly in rear plate 14 in association with keyways 22'. Openings 30,30' are threaded and are provided with an enlarged entry portions in order to accommodate screws with flat heads which can secure key elements in place and be flush with the surface of the housing plates. Openings 30,30' are drilled in proximity to keyways 22, 22' so that the enlarged screw head portions extend partially into the keyway. One or more of openings can be provided in association with each keyway to positively locate a key element therein. Openings 32 are positioned along a circumferential path on an imaginary circle of smaller diameter than imaginary circle 24. These openings extend through plate 12 and need not be threaded since they accommodate pins. Similar openings 32' are provided in plate 14. Openings 32,32' are provided 90° apart and they are also spaced 90° from two other similar openings, not shown, in the gear for locating positioning pins therethrough. As should be apparent, the positioning openings are all 90° apart and are located on the same circumference, for reasons which will become apparent, but on a smaller radius than circle 24, both, of course, being concentric.

Figure 3:
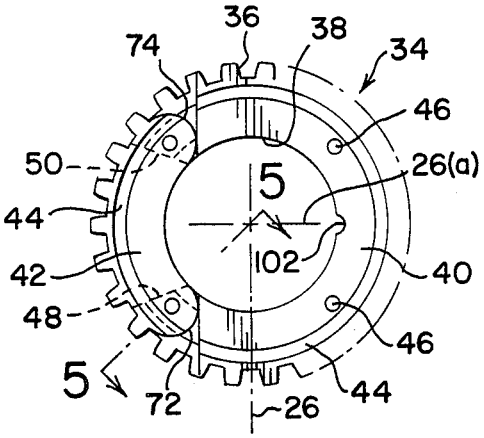
FIG. 3 is a front view of the wrench gear showing a removable gear portion that can be swung open to permit insertion of a collet.

FIG. 3 illustrates circular gear 34, that is normally disposed within housing 10 for rotation therein and having appropriate gear teeth 36. Gear 34, which has an inner cylindrical opening defined by cylindrical structure 38, is composed of two sections: major gear section 40 and minor gear section 42. Gear 34 also has continuous circumferential groove 44 on its front face that traverses major gear section 40 and minor gear section 42. Similar groove 44' is provided on the opposite face of gear 34. Major gear section 40 includes openings 46 that pass through gear section 40. In the position shown in FIG. 3, the two openings 46 on the right hand side and right of centerline 26, can be aligned with openings 32, 32' in plates 12, 14 to retain pins passing therethrough as well as through the plates of the housing and the gear, whenever it is desired to service the gear or to open the minor gear section 42. Major gear section 40 has an arcuate extent greater than 180°, and more nearly about 270°, terminating at boundaries denoted by dotted lines 48, 50. Openings **46(*a*) and 46(*b*) (FIG. 4) pass through both the major and minor gear sections 40, 42** and, in assembled condition, the two gear sections are secured together by pins passing therethrough.

Figure 4:
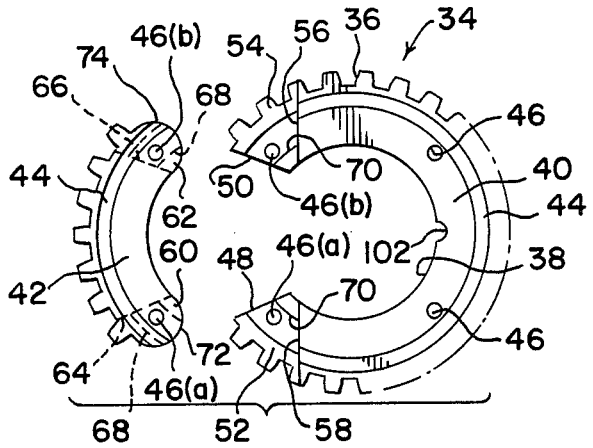
FIG. 4 a front view of the two gear parts shown apart which can be assembled and held together by means of a pair of pins.

FIG. 4 shows the major and minor gear sections 40, 42 separated in a disassembled condition. Minor gear section 42, when assembled, is disposed over cooperating portions of major gear section 40. The engagement between major and minor gear sections is obtained by means of a number of different features. In this regard, gear section 40 has engaging sections 52,54. Section 52 is defined by end boundary 48 and shoulder 58 whereas section 54 is defined by end boundary 50 and shoulder 56. Sections 52,54 are of a reduced uniform thickness when compared to the rest of gear section 40 defined by respective shoulders 56,58. There are similar engaging sections 60,62 on minor gear section 42, extent of which is defined by respective shoulders defined by dotted lines 64,66. Engaging sections 60,62 are also of reduced thickness compared to the thickness of the minor gear section 42. As should be apparent, thickness of major and minor gear sections is about the same and the engaging sections are each reduced in thickness sufficiently to present a combined thickness equivalent to the thickness of the gear sections along the circumference of the gear. Minor gear section 42 also has complementary openings 46(*a*),46(*b*) which align with similar openings in the major gear section when the two gear sections are in assembled condition with the engaging sections of the respective gear sections being disposed over each other in cooperative and mating relationship.

FIG. 5 shows an enlarged view of engaging sections 52,60 on the major and minor gear sections 40,42, shown in FIG. 3. The purpose of FIG. 5 is to illustrate the tongue and groove arrangement that is responsible for locating the major and minor gear sections relative to each other. It should be understood that a similar arrangement of parts exists at the other junction of the major and minor gear sections. Therefore, as shown in FIG. 5, a tongue section 68 is provided on engaging section 60 that extends from shoulder 64 to the end of the gear section shereas a corresponding groove section 70 is provided on engaging section 52 that extends from shoulder 58 to the boundary line 48 that defines the termination of gear section 40. The tongue and groove arrangement provides a positive and a secure disposition of the major and minor gear section 40,42 relative to each other which is facilitates proper and effective operation of the wrench.

FIGS. 3, 4, and 5 also clearly illustrate another important feature of the subject wrench. As shown, minor gear section 42 has rounded terminal portions 72,74 which permit the minor gear section 42 to be swung around shoulder 50 and the fulcrum identified by openings 46(*a*) in the minor and major gear sections, when in assembled condition.

FIG. 6 shows a perspective view of a key element 76 with a pair of flat-head sect screws 78,80 which can be screwed in or out. Each key element 76 is elongated and is arcuate for the reason that it is designed to be nestled in groove 44 of gear 34, and similarly on the other side of the gear. When the set screws are in their retraction position, they are flat and are flush with the upper surface of key element 76. When desired, the set screws can be unscrewed until they protrude out sufficiently so that they can be grasped by hand or tool and the key element can be removed from or inserted into one of the keyways 22 provided in housing 10. The thickness of key element is such as to protrude through housing plate 12 and into circumferential groove 44 in gear 34. Groove 44 is about $\frac{1}{4}''$(0.63 cm). It should be remembered that similar key elements are disposed in keyways and grooves on the opposite face of the wrench. Such an arrangement permits the positive positioning of the gear within the housing whereby the gear can be made to rotate about the axis defined by the intersecting centerlines 26,26(*a*).

FIGS. 7 and 8 illustrate certain features of collet 82 that is composed of two sections: major section 84 and minor section 86. Outer body of collet 82 is cylindrical and is adapted to fit into the inner cylindrical opening in gear 34 defined by circumferential cylindrical structure 38. FIG. 8 shows collet 82 provided with a circumferential lip 88 which, in assembled condition is disposed over gear 34. The body of collet 82 extends into the cylindrical gear opening. As is shown in FIG. 7 major collect section 84 has lip 88(*a*) and minor collet section 86 has lip 88(*b*). The over-all thickness of the collet can be such as to have its protruding portions flush with plates 12,14 of the housing, as shown in FIG. 8. A partial opening can be provided in the collet and a corresponding partial opening can be provided in the gear extending the length of the collet and the gear. When the partial openings are made to coincide, they form a complete opening through which a pin can be passed for the purpose of securing the collet and the gear in unison. Of course, other means can be provided to accomplish the same result. Major collet section 84 is provided with an inner opening defined on the sides by rectilinear structure 90, which can be rectangular or square or any other form desired to fit a particular work piece. One side of the rectilinear structure 90 of the major collet section is left open, as at 92. Interior portion of minor collet section 86 is a planar surface 94 which is adapted to close-off opening 92 of the major collet section when the two collet sections are in assembled condition. The outer surface of collet 82 is cylindrical.

Figure 9:
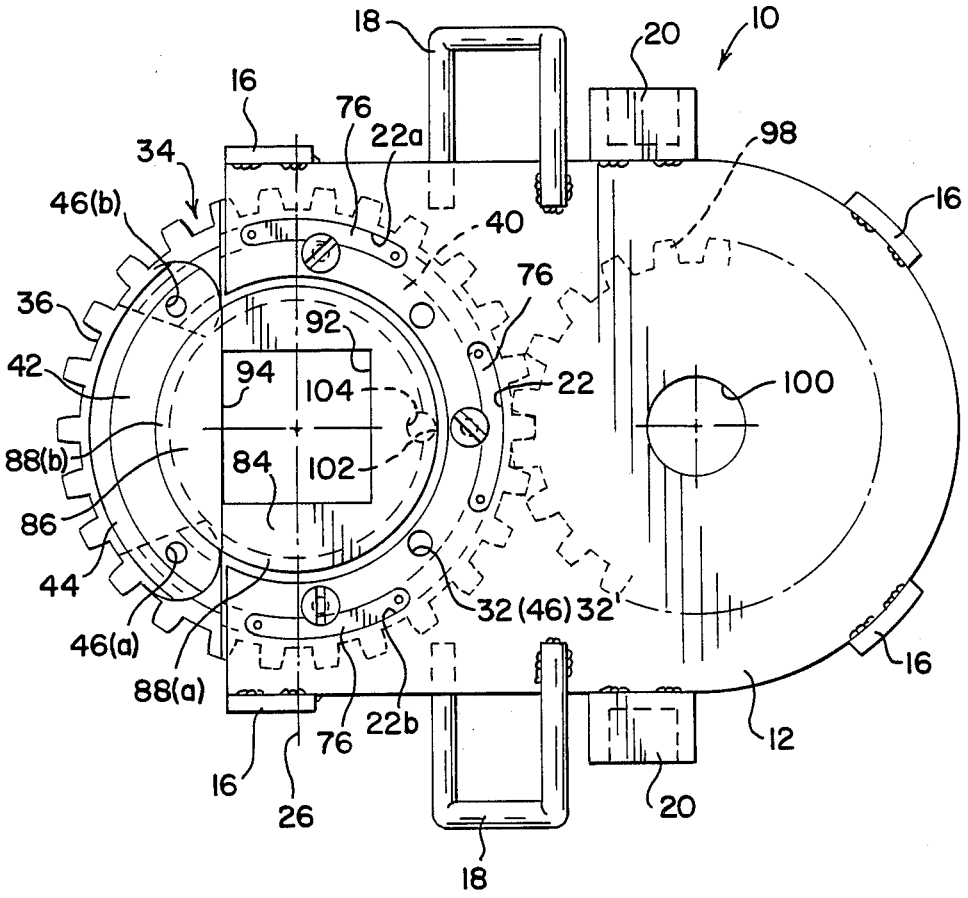
FIG. 9 is a front view of assembled wrench showing the collet disposed within the gear and the gear disposed within the housing.

FIG. 9 shows the wrench in assembled condition. Assembly of the wrench is commence with gear housing 10 into which is inserted drive gear 98 through the open front end of housing 10. Drive means 98 has an opening that coincides with opening 100 in the housing. A drive shaft, not shown, is passed through the opening 100 in the housing 10 and through an ligned opening in drive means 98. As should be evident also, the drive shaft extends through housing plates 12,14. In such a manner, drive means 98 is positioned on a drive shaft within the housing 10. Cooperating means known in the art can be provided on either the drive shaft or drive means 98 to secure the two components for rotation in unison. It should be understood that drive means can be an angle gear or it can comprise a drive train to multiply the input torque imparted to the drive shaft for rotating or turning gear 34. Any desired motive force can be applied to the drive shaft to provide the motive force to gear 34. This can be in the form of an ordinary drill, an impact wrench, a worm gear, or any other means for turning the gear.

After positioning drive means 98 within the housing, as described, major gear section 40 is also placed within the housing and openings 46 therein are aligned with openings 32,32' in the housing. Pins, not shown, are then pushed through aligned openings 32,32',46, and extend through housing plates 12,14. Pins disposed in openings 32,32',46 position major gear section 40 within gear housing 10 in such a manner that keyways 22,22' are aligned with grooves 44,44' in the major gear section 40. Since the gear cannot turn with pins disposed in openings 32,32',46, provision is made to free these pins and thus permit the gear to turn. This provision is dependent on key elements 76,76' being inserted into keyways 22,22'. The key elements project into grooves 44,44' of gear 34 and thus are used to position the gear within the gear housing. Although provision for three key elements is made in FIG. 9 on the front face of the gear, it should be understood that any suitable number of key elements and cooperating keyways can be used as long as the gear is secured by the key elements through an arc of at least 180°. After the key elements are assembled and are made to support gear 34 within housing 10, the pins passing through aligned openings 32,32',46 can be withdrawn to permit the gear to turn on the key elements.

As can be appreciated by one skilled in the art, turning of gear 10 on key elements 76,76' which support the gear through sliding contact with grooves 44,44' provided in the gear, is difficult and can result in locking between the key elements and the gear grooves. Therefore, to facilitate turning or rotation of the gear on the key elements, the cooperating structural elements should be designed to provide for smooth sliding motion between the grooves and the key elements and for a relatively long life of such elements. This objective can be achieved by many different means known in the art, however, for reason of simplicity and practicality, the cooperating surfaces can be made of different metals or the same metal as long as one surface is made of a harder metal and the other surface is made of a softer metal. Since the key elements can easily be removed and changed, it makes sense to make them of a softer metal than the metal surface in the gear grooves 44,44'. Once key elements are disposed within keyways 22,22' set screws with flat heads, not shown, can be screwed into threaded openings 30,30' positioned adjacent each keyway in a manner so that the head portion of the screw positively secures each key element in its respective keyway.

To complete assembly of gear 34, minor gear section 42 is secured at the lower portion of major gear section 40 by aligning openings 46(*a*) and 46(*b*) and forcing a pin therethrough. In such an arrangement, minor gear section 42 is swingably attached to major gear section 40 by means of the pin passing through the aligned openings. Since the gear sections are also aligned relative to each other by means of tongue 68 of engaging section 60 registering with groove 70 of engaging section 52, the swinging action of minor gear section 42 about aligned openings 46(*a*),46(*b*) can only be realized by disengaging the tongue 68 and groove 70 from each other. Before engaging the other end of minor gear section 42 with the remaining end of major gear section 40, major collet section 84 is inserted into the inner gear opening, with cylindrical surfaces of each being arranged concentrically. As FIG. 8 shows clearly, in this arrangement, lip 88 of collet 82 is disposed against front face of gear 34.

With major collet section 84 disposed within major gear section 40 and minor gear section 42 hanging on a pin passing through aligned openings 46(*a*),46(*b*), opening 92 in collet 82 is unobstructed and can be advanced and placed directly over a section of a work piece intermediate its ends. As earlier explained, this wrench is particularly suitable for use on objects that have fixed ends so that a wrench cannot be slipped over one or the other end. Once the collet is disposed over a work piece, the shape of which complements the inner opening of the collet minor collet section 86 is positioned in place to close off open end 92 and thus contain the work piece within the inner opening in the collet. The minor gear section 42 is then swung upwardly against minor collet section 86 and the engaging portions 52,60 and 54,62 are aligned and forced against each other so that the respective tongue and groove structures are disposed in registry with each other. In this arrangement, upper openings 46(*a*),46(*b*) fall into alignment and a pin, not shown, is passed therethrough to secure the minor gear section to the major gear section. In such a condition, gear 34 has a continuous circumferential groove 44 traversing the major and minor gear sections. Incidentally, the thickness of gear 34 is uniform circumferentially when the gear sections are in assembled or operating condition.

In order to turn a work piece, a suitable motive means is used to impart torque to drive means 98 which transmits the torque to gear 34. Partial openings 102,104 in major gear section 40 and major collet section 84 are aligned to form a complete opening that extends the thickness of each section. A pin, not shown, is inserted in the openings 102,104 which pin securely engages major gear section 40 with major collet section 84 and prevents relative rotation of the two sections. Therefore, when a torque is transmitted to gear 34, the gear turns on its key elements 76,76' disposed in keyways 22,22' and carries with it collet 82. The work piece, which is secure within the collet, is also turned in such a fashion.

When it is desired to disengage a work piece and to change the collet, the pins securing the minor gear section to the major gear section are removed and the minor gear section is retracted or the minor gear section can be removed from the pins and the minor collet section thus removed. In this position, one side of the collet is open, exposing an unobstructed passage through which the work piece can be extracted along with the collet. Another collet can be inserted through the passage having an outer surface that complements the inner cylindrical surface of the gear. This collet can have an inner opening of a different geometrical shape to complement an engaging section of a different work piece which it is desired to turn. The procedure for closing off the collet opening is repeated, in the manner already described.

I claim:

1. A wrench for fastening, loosening, or adjusting a work piece, particularly one having both of its ends affixed, comprising a housing, a circular gear having an internal transverse opening disposed within said housing for rotation relative to said housing, gear teeth provided on the outer periphery of said gear, gear supporting means cooperating with said housing and at least one face of said gear for positioning said gear within said housing for rotation, said gear is composed of a major gear section having an arcuate extent greater than 180° and a minor gear section having on arcuate extent of less than 180°, said gear sections defining a closed circular structure in operating condition, means for removably securing said gear sections together, a removable collet means disposed within said internal opening of said gear and being supported thereby, said collet means having an interior passage of a geometric shape with an open side, means for removably securing said collet means to said gear for rotation therewith, said minor gear section being in alignment with the open side of said collet means to provide unimpeded entry of a work piece into the passage within said collet means when said minor gear section is disengaged from said major gear section, and drive means in cooperation with said gear for transmitting rotary motion to said gear.

2. Wrench of claim 1 wherein said housing comprises spaced plates with said gear disposed therebetween, a circular cutout portion provided in the front edge of each plate for exposing said internal gear opening, said circular cutouts being in correspondence with each other and each having an arcuate extent of greater than 180° but less than 360°.

3. Wrench of claim 1 wherein said gear supporting means comprises a continuous circular groove provided in said gear on both faces thereof, arcuate openings in each of said plates arranged on a circumference coinciding with said circular grooves, engaging elements projecting through said openings and into said grooves for positioning said gear within said housing.

4. Wrench of claim 1 including a separate block element for closing-off the open side of said collet means, said block element being positioned within said internal gear opening and being supported in position by said minor gear section when in operating condition.

5. Wrench of claim 2 wherein said supporting means comprises a continuous circular groove in each face of said gear, at least two arcuate elongated keyways provided in each plate and passing therethrough, said keyways being arranged circumferentially and being in alignment with said grooves, and arcuate key elements disposed in said keyways and projecting into said grooves, said key elements having sufficient arcuate extent to maintain said gear securely between said plates.

6. Wrench of claim 5 wherein said internal gear opening is in the form of a cylindrical passage, and said collet means and said block element each have complementing cylindrical outer surfaces and are disposed within said internal opening of said gear.

7. Wrench of claim 6 including and engaging section on said major and minor gear sections defined by a shoulder and a reduced section, said engaging sections of said major and minor gear sections being complementary and overlapping each other when in operating condition.

8. Wrench of claim 7 including complementing tongue and groove structures on said engaging sections of said major and minor gear sections for securely positioning said gear sections relative to each other.

9. Wrench of claim 6 including openings in said engaging sections of said major and minor gear sections which can be brought into alignment, and pins passing through the aligned openings in the gear sections to removably secure said gear sections to each other when in operating condition.

10. Wrench of claim 9 including at least one auxiliary opening in at least one of said housing plates disposed over said gear, at least one auxiliary opening in said gear that can be aligned with said auxiliary opening in said housing plate, and a pin passing through the aligned auxiliary openings for maintaining said gear in a fixed position to facilitate removal of said collet means.

11. Wrench of claim 5 wherein the contacting surface in said grooves is harder than the contacting surfaces of said key elements.

12. Wrench of claim 9 including rounded ends on minor gear section provided to facilitate turning thereof about a pin passing through engaging sections of said major and minor gear sections.

13. Wrench of claim 11 including a drive means disposed within said housing and being operatively engaged with said gear for transmitting rotary motion to said gear.

* * * * *